United States Patent [19]

Ode et al.

[11] Patent Number: 4,500,261

[45] Date of Patent: Feb. 19, 1985

[54] PUMP MEANS FOR PUMPING A MIXTURE OF COARSE-GRAINED MATERIAL AND FLUID

[75] Inventors: Bengt Ode; Lars Törnblom, both of Västerås, Sweden

[73] Assignee: Ab Asea-Atom, Vasteras, Sweden

[21] Appl. No.: 477,545

[22] Filed: Mar. 21, 1983

[30] Foreign Application Priority Data

Apr. 7, 1982 [SE] Sweden ..... 8202248

[51] Int. Cl.[3] ..... F04B 23/12; F04B 23/14; F04B 35/04

[52] U.S. Cl. ..... 417/203; 417/205; 417/271

[58] Field of Search ..... 417/203, 205, 271; 91/499, 485, 506

[56] References Cited

U.S. PATENT DOCUMENTS

| | | | |
|---|---|---|---|
| 3,183,845 | 5/1965 | Tyler | 91/506 |
| 3,369,491 | 2/1968 | Hoffer | 417/271 |
| 3,641,881 | 2/1972 | Hashemi | 417/225 |
| 3,657,976 | 4/1972 | Kobayashi | 91/485 |
| 3,999,895 | 12/1976 | Boyle | 417/271 |
| 4,174,925 | 11/1979 | Pfenning | 417/225 |

FOREIGN PATENT DOCUMENTS

| | | | |
|---|---|---|---|
| 1200135 | 9/1965 | Fed. Rep. of Germany | 91/499 |
| 3041832 | 5/1982 | Fed. Rep. of Germany | 91/499 |
| 513989 | 2/1955 | Italy | 91/499 |
| 155742 | 8/1956 | Sweden . | |
| 781204 | 8/1957 | United Kingdom | 417/206 |
| 1411084 | 10/1975 | United Kingdom | 91/499 |

*Primary Examiner*—William L. Freeh

*Attorney, Agent, or Firm*—Pollock, Vande Sande & Priddy

[57] ABSTRACT

A pump for pumping a mixture of a liquid and a coarse-grained material comprises a motor-driven rotor (1) having a plurality of longitudinal cylinders (5, 6, 7, 8) having individual piston members (9), whereby these are driven back and forth by means of a pressure medium which is supplied to one end of the rotor. At the other end of the rotor, the cylinder openings, during rotation, pass a stationary inlet channel (21) and a stationary outlet channel (22) for the mass that is to be pumped. The rotor (1) is designed as a truncated cone, the cylinders being obliquely positioned with respect to the axis of rotation and having the greatest radial distance thereto at the cylinder ends which cooperate with the above-mentioned inlet and outlet channels.

3 Claims, 7 Drawing Figures

PUMP MEANS FOR PUMPING A MIXTURE OF COARSE-GRAINED MATERIAL AND FLUID

TECHNICAL FIELD

The present invention relates to a pumping device for pumping a mixture of liquid and solid material, comprising a rotor body with a longitudinal axis which extends between a first and a second end surface of the rotor body and coincides with the axis of rotation, a driving device arranged to give said rotor body a rotating movement, an auxiliary pump for a pressure medium, a first stationary guiding member and a second stationary guiding member, a plurality of cylindrical bores made in said rotor body and extending between said end surfaces, a plurality of piston members, each of said bores containing a corresponding piston member, each piston member comprising a motor piston portion, facing said first guiding member, and a pump piston portion, facing said second guiding member, said first guiding member being disposed adjacent to said first end surface, said second guiding member being disposed adjacent to said second end surface, each of said guiding members having at least one channel pair including an inlet channel and an outlet channel, at least one channel pair belonging to said first guiding member being connected to said auxiliary pump, at least one channel pair belonging to said second guiding member being connectible to an inlet conduit and an outlet conduit for said mixture, each one of the channels of said first guiding member being arranged to be in a pressure-transmitting communication with a corresponding channel in said second guiding member serveral times during a rotor revolution, each time via one of said bores.

BACKGROUND ART

Such a pump means is known from U.S. Pat. No. 3,999,895. In the known pump means, the bores are parallel to the axis of rotation, whereby the inlet opening of the pump means for pumped material consists of an upwardly facing opening in a channel provided in one of the above-mentioned guiding members, said channel having a curvature of about 90°. The upwardly-facing inlet opening makes possible a feeding in which the material is transported by its own weight.

On the other hand the curvature of the inlet channel involves a risk of congestion of material in the curved channel portion if the pump means is used for a mixture of a fluid and coarse-grained particles, for example carbon particles.

With a pump means according to the invention, the intention is to be able to pump such a mixture without the risk of congestion. The object is to provide a pump means in which the rotor body is formed in such a manner that the inlet channel for the pumped material is straight or only slightly curved and, at the same time, makes it possible to utilize the force of gravity for the feeding procedure.

With such a design of the rotor body, the advantage is also obtained that, instead of using a bearing means surrounding the whole rotor body, the rotor body can be journalled by means of two bearings surrounding one shaft end each.

DISCLOSURE OF THE INVENTION

According to the invention the rotor body is substantially formed as a truncated cone, the radial extension of said second end surface being greater than the radial extension of said first end surface, and said bores are obliquely positioned in relation to said longitudinal axis.

Since a pump means according to the invention is able to utilize the gravity as a means of feeding forward a mixture of liquid and solid substances to the rotor channels of the pump means, without being provided for this purpose with a curved inlet channel near the rotor, it has been made possible, in a further development of the invention, to provide the pump means with a conveyor worm inserted into the inlet channel close to the rotor. In this connection, the fact that the inlet channel of the rotor is periodically shut off and opened has been taken into consideration in such a way that the conveyor worm has been arranged to work with a corresponding periodicity.

BRIEF DESCRIPTION OF DRAWINGS

In the following the invention will be described with reference to the accompanying schematic drawings, in which FIG. 1 shows a first embodiment of a pump means according to the invention in axial section through I—I of FIG. 3, whereas

DESCRIPTION OF PREFERRED EMBODIMENTS

Figure 1:
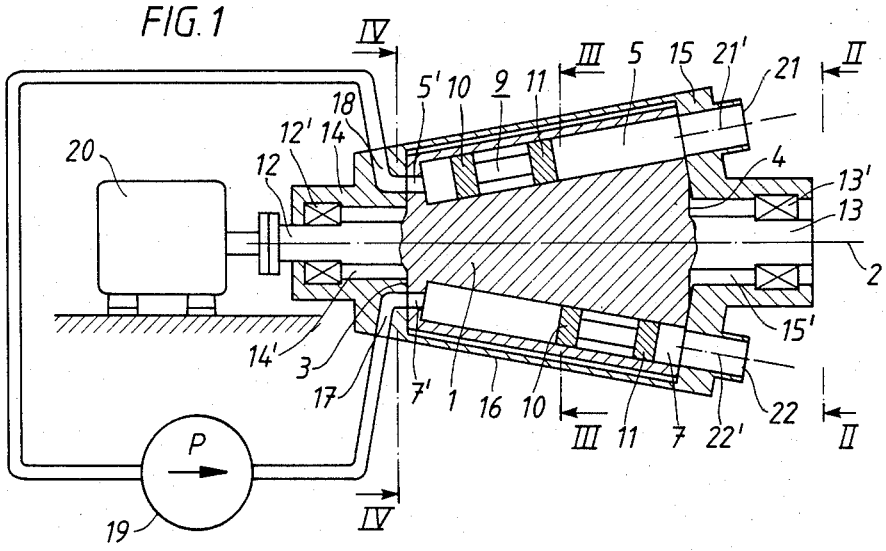

In the drawings, 1 designates a rotor body which is arranged to rotate about an axis which coincides with a longitudinal symmetry axis 2 through the rotor body. The rotor body 1 is substantially designed as a truncated cone having a smaller end surface 3 and a larger end surface 4. The rotor body 1 has four mutually similar, substantially circular-cylindrical bores 5, 6, 7 and 8, each of which extending between the end surfaces 3 and 4. The bores are symmetrically arranged with respect to the axis 2 and their centre lines intersect the symmetry axis 2 at one and the same point. Each of the bores 5, 6, 7 and 8 is provided with a piston member 9. Each piston member 9 comprises a motor piston 10 facing the end surface 3 and a pump piston 11 facing the end surface 4, the pistons 10 and 11 being rigidly connected to each other. The rotor body 1 is provided with two shaft ends 12 and 13 with associated bearings 12' and 13', respectively, each of which is supported by a guiding member 14 and 15, respectively. Each of the two guiding members has a central hole 14' and 15', respectively, in which the bearings 12' and 13' are arranged. The guiding members 14 and 15 are mechanically connected to each other by means of a conical casing 16 arranged radially outside the rotor body and, together with this, form a stator. The guiding members 14 and 15 make contact with the end surfaces 3 and 4, respectively, with no mentionable play. The guiding member 14 is provided with an inlet channel 17 and an outlet channel 18 for a pressure medium, usually water, which channels are connected to the output side and the inlet side, respectively, of a pump 19. The shaft end 12 is flanged to the relatively slowly rotating output shaft of a geared motor 20. The guiding member 15 is provided with an inlet channel 21 and an outlet channel 22 for the material to be pumped by means of a pump means according to the invention. This may, for example, be a mixture of water and carbon particles of such a grading that at least 10% of the carbon amount consists of particles, the largest dimension of which constitutes at least 25% of the smallest transversal dimension of the inlet channel 21.

At the end surface 3 of the rotor body, each of the two channels 17 and 18 in the guiding member 14 has a tangential extension of 90°, which means that at least one of the bores 5, 6, 7 and 8 with a corresponding thin portion 5', 6', 7' and 8', respectively, is always in a hydraulic connection with an inlet channel 17, and that at least one of these bores is in the same way in connection with the outlet channel 18.

Each of the channels 17 and 18 is divided symmetrically by an imaginary vertical plane through the symmetry axis 2, and this is also the case with the channels 21 and 22 which, similarly to channels 17 and 18, are funnel-shaped, each one of the channels 17, 18, 21, 22 having a circular cross-section in its axially outermost portion and a ring sector-shaped cross-section nearest the rotor body 1.

In the rotor position shown in the drawing, the centre line 21' and 22', respectively, of each of the channels 21 and 22 lies in the extension of the centre line of a corresponding bore 5 and 7, respectively, which means that the channel 21 is straight and has a fall in a direction towards the rotor body 1. The rotor body 1 is formed with such a great conicity that the bores intended for the piston members 9 make an angle of at least 4°, preferably at least 8°, with the symmetry axis 2.

Figure 5:
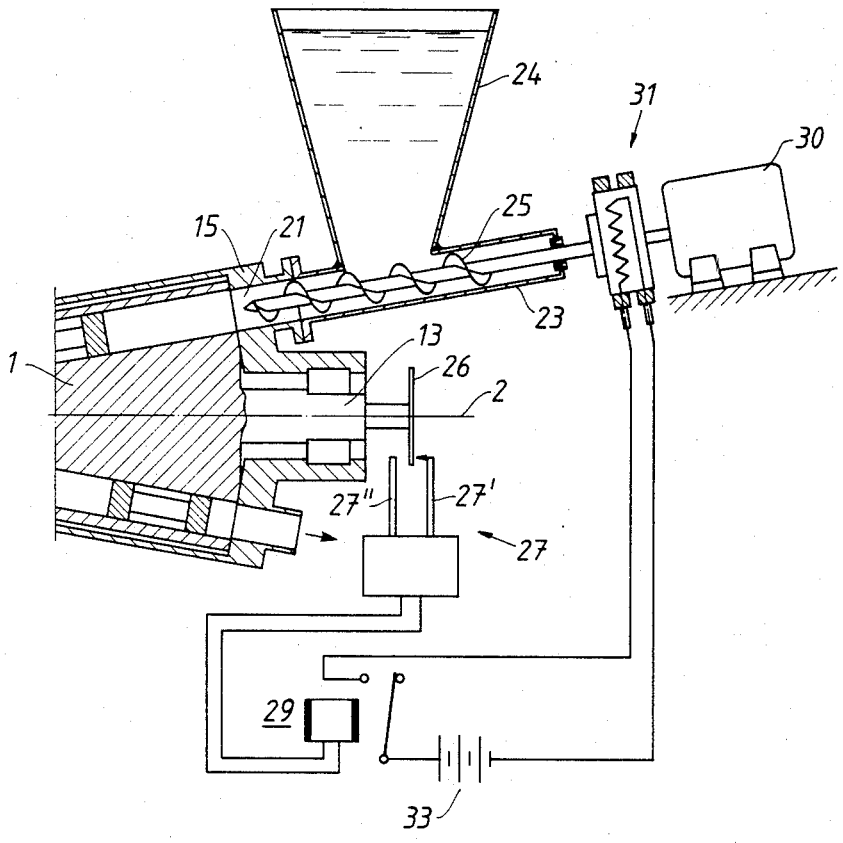
FIGS. 5 and 6 show axial sections of a second and a third embodiment of the invention.
Figure 6:
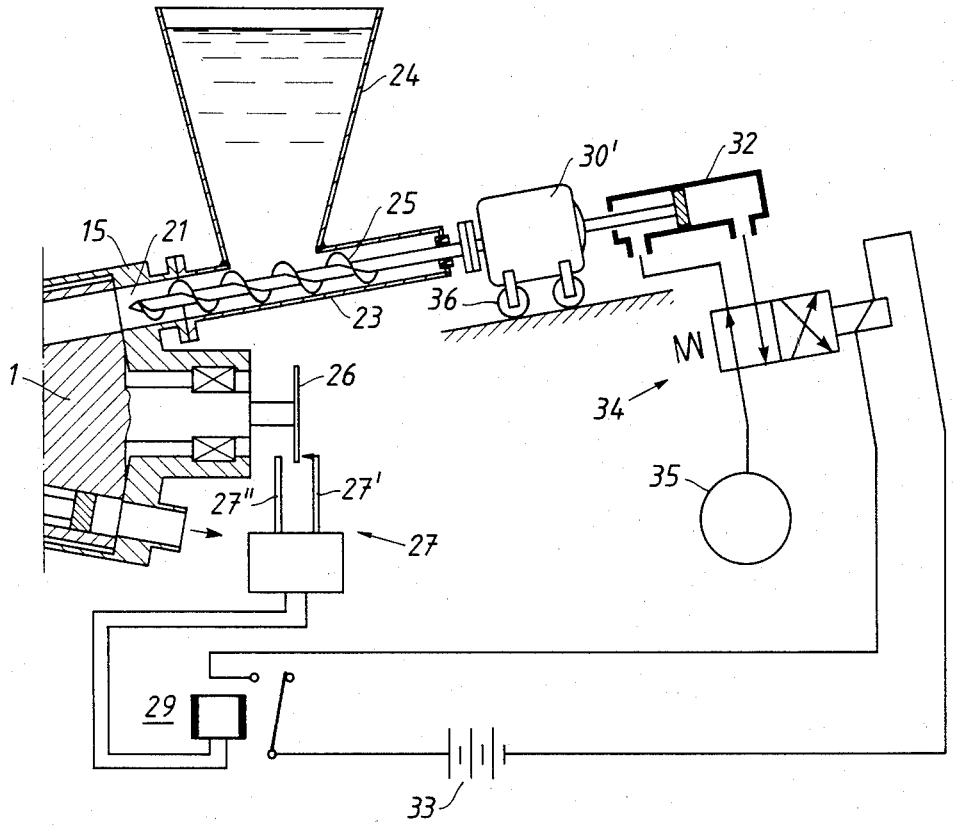

The embodiments shown in FIGS. 5 and 6 relate to the above-mentioned further developed embodiment of the invention, according to which the pump means is provided with a conveyor worm device. This includes a conveyor tube 23 connected to the inlet channel 21. The tube 23 is arranged, via an opening in the tube wall, in hydraulic connection with a feeding pocket 24 arranged above the conveyor tube. The conveyor tube comprises a conveyor worm 25 driven by a rotating electrical motor, said conveyor worm being arranged at the above-mentioned tube opening and inserted with one end into the inlet channel 21.

As mentioned, the channels 17 and 18 connected to the water pump 19 have, nearest the rotor body 1, a tangential extension which corresponds to a central angle of 90°. On the other hand, the corresponding extension of the inlet channel 21 and the outlet channel 22 for the pumped material is considerably smaller than 90° since the pump means is intended to pump a material which, when being fed in with a feeding force directed along the mid-axis of the inlet channel, has a relatively low capacity to transmit pressure in the peripheral direction.

Figure 2:
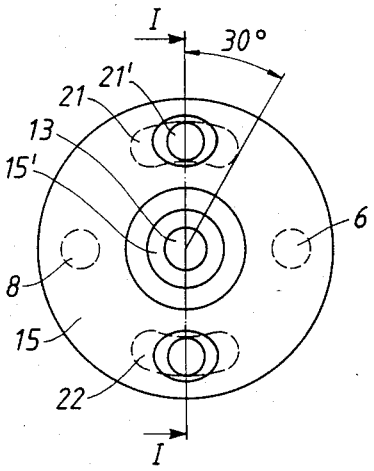
FIGS. 2, 3 and 4 show sections along II—II, III—III and IV—IV, respectively, of FIG. 1.
Figure 3:
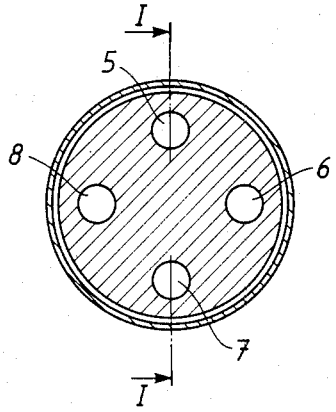
Figure 4:
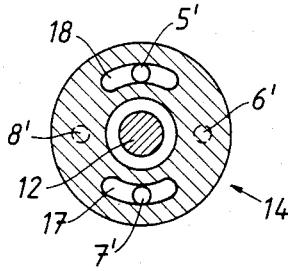
Figure 7:
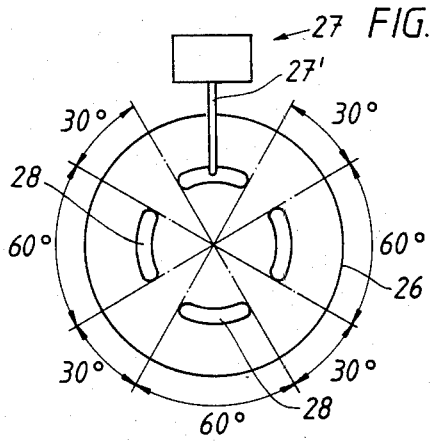
FIG. 7 shows an axial view of a transducer used with these embodiments.

In the arrangement shown with reference to FIG. 2, each one of the channels 21 and 22 has a maximum tangential extension which corresponds to a central angle of about 60°. At time intervals at which none of the openings of the bores 5, 6, 7, 8 for the most part coincides with the inlet channel 21, the conveying effect of the conveyor worm 25 should be considerably reduced or interrupted, which in FIG. 5 and FIG. 6 takes place by means of an electromagnetic shaft coupling 31 and an operating cylinder 32, respectively. Based on the angular position of the rotor body 1 shown in FIG. 2, this means that a signal for reduced worm feeding is given when the rotor body has been rotated approximately 30° in a counterclockwise direction in relation to the angular position shown in FIG. 2. After an additional 30° rotation of the rotor body 1, the opening of the bore 6 coincides to about 50% with the opening of the inlet channel 21 facing the rotor body 1, and a signal is given for renewed activation of the conveyor worm 25. The above-mentioned signals are given with the aid of an angular position transducer 27, known per se, which comprises a circular disc 26 which, via an extension element, is fixed to the shaft end 13 with an adjustable angular position. The disc 26 has four through-holes 28 made with adjustable tangential extension. The transducer 27 also comprises two arms 27' and 27'', which are each arranged on one side of the disc 26 and support a light-emitting diode (LED) and a photo-diode, respectively, said photo-diode being arranged opposite to said LED, the output side of the transducer 27 supplying a signal in the form of a voltage at all angular positions at which the photo-diode receives light from the LED through one of the four openings 28. At all other angular positions, the output voltage of the transducer 27 is equal to zero, which means that a relay 29, connected to the output side of the angular position transducer 27, has the contact position shown on FIG. 5 and FIG. 6, whereby an operating circuit, which includes a current source 33, is currentless. In the embodiment of the invention shown on FIG. 5, this means that the electromagnetic shaft coupling 31 is inactive such that no torque is transmitted from the motor 30 to the conveyor worm 25.

On FIG. 6, the numeral 34 designates a two-way valve having two positions, electromagnetic control and spring return, whereas the numeral 35 designates a compressed-air container which is connected to the operating cylinder 32 via the valve 34. The conveyor worm 25 is driven by a rotating electric motor 30', which is supported by a plurality of wheels 36 in such a way that the motor 30' has freedom of movement in the axial direction. In the shown contact position of the relay 29, the operating cylinder 32 exerts an axial force on the stator of the motor 30', the worm 25 thus being subjected to an axial displacement in a direction away from the inlet channel 21, which means that the material transport is interrupted or reduced for as long as this displacement proceeds. As soon as a new hole 28 arrives into such a position that the photo-diode and the LED can cooperate, the piston movement in the operating cylinder 32 is reversed and this cylinder contributes to transport the coal-water mixture, delivered from the feeder pocket 24, to the inlet channel 21.

A pump means according to the invention can be constructed in many variants in addition to those described above. Thus, for example, a variant may be imagined which only differs from those described above in that the inlet channel 21 is constructed with a considerably greater tangential extension nearest the rotor body 1, for example with an extension which, instead of corresponding to 60°, corresponds to 100° or more. It is true that in such a case the hydraulic connection between the channels of the rotor body and the inlet channel will always have a total cross-section which is greater than the cross-section of each of the channels 5, 6, 7 and 8, but since the ability of the mixture to move in the lateral direction may be insufficient, it may be suitable to limit the feed intervals to the same degree as with the devices described with reference to FIGS. 5 and 6.

If it is desired to distribute the pumped mixture on to two outgoing conduits, each one of the guiding members 14 and 15 may be constructed with four channels, evenly distributed in the tangential direction, whereby the two outlet channels—similarly to the inlet channels—are arranged at a distance of 180° from one another.

We claim:

1. A pump apparatus for pumping a mixture of liquid and solid material, comprising:

a rotor body with a longitudinal axis which extends between a first end surface and a second end surface of the rotor body and coincides with an axis of rotation;

a drive means arranged to give said rotor body a rotating movement about said axis of rotation;

an auxiliary pump for providing a pressure medium;

a first stationary guiding member having a first inlet channel and a first outlet channel;

a second stationary guiding member having a second inlet channel and a second outlet channel;

a plurality of cylindrical bores made in said rotor body and extending between said end surfaces; and, a plurality of piston members, each of said bores containing a corresponding piston member, and each piston member comprising a motor piston portion facing said first guiding member and a pump piston portion facing said second guiding member;

wherein said first guiding member is disposed adjacent to said first end surface and said second guiding member is disposed adjacent to said second end surface;

wherein said first inlet channel and said first outlet channel are connected to said auxiliary pump;

wherein said second inlet channel is directly connected to a conveyor tube for said mixture and said second outlet channel is connectible to an outlet conduit for said mixture;

wherein said conveyor tube, via an opening in the tube wall, is connected to a feeding pocket arranged above the conveyor tube, said conveyor tube comprising a conveyor worm one end of which is insertable into said second inlet channel;

wherein each one of the channels of said first guiding member is arranged to be in a pressure-transmitting communication with a corresponding channel in said second guiding member more than one time during a rotor revolution, each time via one of said bores; and, wherein said rotor body is substantially formed as a truncated cone, the radial extension of said second end surface being greater than the radial extension of said first end surface, and said bores being in diverging relation to each other in a direction towards said second guiding member.

2. A pump apparatus for pumping a mixture of liquid and solid material, comprising:

a rotor body with a longitudinal axis which extends between a first end surface and a second end surface of the rotor body and coincides with an axis of rotation;

a drive means arranged to give said rotor body a rotating movement about said axis of rotation;

an auxiliary pump for providing a pressure medium;

a first stationary guiding member having a first inlet channel and a first outlet channel;

a second stationary guiding member having a second inlet channel and a second outlet channel;

a plurality of cylindrical bores made in said rotor body and extending between said end surfaces; and, a plurality of piston members, each of said bores containing a corresponding piston member, and each piston member comprising a motor piston portion facing said first guiding member and a pump piston portion facing said second guiding member;

wherein said first guiding member is disposed adjacent to said first end surface and said second guiding member is disposed adjacent to said second end surface;

wherein said first inlet channel and said first outlet channel are connected to said auxiliary pump;

wherein said second inlet channel is directly connected to a conveyor tube for said mixture and said second outlet channel is connectible to an outlet conduit for said mixture;

wherein said conveyor tube, via an opening in the tube wall, is connected to a feeding pocket arranged above the conveyor tube, said conveyor tube comprising a conveyor worm one end of which is insertable into said second inlet channel;

wherein said conveyor worm is provided with means for reducing or interrupting the conveying effect of the worm in such a way that said reduction or interruption occurs during a plurality of time intervals during each revolution of said rotor body, said means being interlocked with the movement of the rotor body in such a way that said reduction or interruption is started upon exceeding a certain tangential distance between one of said bores and the center line of said second inlet channel present in said second guiding member, and said reduction or interruption is terminated as soon as the tangential distance between the center line of said second inlet channel and the nearest of said bores has been reduced to a certain value;

wherein each one of the channels of said first guiding member is arranged to be in a pressure-transmitting communication with a corresponding channel in said second guiding member more than one time during a rotor revolution, each time via one of said bores; and, wherein said rotor body is substantially formed as a truncated cone, the radial extension of said second end surface being greater than the radial extension of said first end surface, and said bores being in diverging relation to each other in a direction towards said second guiding member.

3. A pump apparatus for pumping a mixture of liquid and solid material, comprising:

a rotor body with a longitudinal axis which extends between a first end surface and a second end surface of the rotor body and coincides with an axis of rotation;

a drive means arranged to give said rotor body a rotating movement about said axis of rotation;

an auxiliary pump for providing a pressure medium;

a first stationary guiding member having a first inlet channel and a first outlet channel;

a second stationary guiding member having a second inlet channel and a second outlet channel;

a plurality of cylindrical bores made in said rotor body and extending between said end surfaces; and, a plurality of piston members, each of said bores containing a corresponding piston member, and each piston member comprising a motor piston portion facing said first guiding member and a pump piston portion facing said second guiding member;

wherein said first guiding member is disposed adjacent to said first end surface and said second guiding member is disposed adjacent to said second end surface;

wherein said first inlet channel and said first outlet channel are connected to said auxiliary pump;

wherein said second inlet channel is directly connectible to an inlet conduit for said mixture and said second outlet channel is connectible to an outlet conduit for said mixture;

wherein each one of the channels of said first guiding member is arranged to be in a pressure-transmitting communication with a corresponding channel in said second guiding member more than one time during a rotor revolution, each time via one of said bores;

wherein said rotor body is substantially formed as a truncated cone, the radial extension of said second end surface being greater than the radial extension of said first end surface, and said bores being in diverging relation to each other in a direction towards said second guiding member; and, wherein said second inlet channel and said second outlet channel are each substantially straight and diverge relative to each other in substantially the same relation as said rotor bores diverge from each other.

* * * * *